US007694730B2

(12) United States Patent
Angman

(10) Patent No.: US 7,694,730 B2
(45) Date of Patent: Apr. 13, 2010

(54) SPEAR TYPE BLOW OUT PREVENTER

(75) Inventor: Per G. Angman, Calgary (CA)

(73) Assignee: Tesco Corporation, Huston, TX (US)

( * ) Notice: Subject to any disclaimer, the term of this patent is extended or adjusted under 35 U.S.C. 154(b) by 596 days.

(21) Appl. No.: 10/599,076

(22) PCT Filed: Mar. 18, 2005

(86) PCT No.: PCT/CA2005/000570

§ 371 (c)(1),
(2), (4) Date: Dec. 29, 2006

(87) PCT Pub. No.: WO2005/090740

PCT Pub. Date: Sep. 29, 2005

(65) Prior Publication Data

US 2008/0230224 A1 Sep. 25, 2008

Related U.S. Application Data

(60) Provisional application No. 60/521,252, filed on Mar. 19, 2004.

(51) Int. Cl.
*E21B 33/04* (2006.01)

(52) U.S. Cl. ..... 166/77.51; 166/202; 294/86.25

(58) Field of Classification Search ..... 166/85.4, 166/77.51, 202, 387; 294/86.25, 86.1
See application file for complete search history.

(56) References Cited

U.S. PATENT DOCUMENTS

| | | | | |
|---|---|---|---|---|
| 19,047 | A | 1/1934 | Hinderliter | |
| 2,799,348 | A | 7/1957 | Page | |
| 3,136,364 | A | 6/1964 | Myers | |
| 3,438,438 | A | 4/1969 | Conrad | |
| 4,893,678 | A | 1/1990 | Stokley et al. | |
| 5,085,479 | A * | 2/1992 | Taylor | 294/86.17 |
| 5,682,952 | A | 11/1997 | Stokley | |
| 6,173,777 | B1 | 1/2001 | Mullins | |
| 6,309,002 | B1 * | 10/2001 | Bouligny | 294/86.25 |
| 6,311,792 | B1 * | 11/2001 | Scott et al. | 175/162 |
| 6,390,190 | B2 | 5/2002 | Mullins | |
| 6,415,862 | B1 | 7/2002 | Mullins | |
| 6,604,578 | B2 | 8/2003 | Mullins | |
| 6,742,584 | B1 * | 6/2004 | Appleton | 166/98 |
| 2002/0053427 | A1 | 5/2002 | Mullins | |
| 2002/0129934 | A1 | 9/2002 | Mullins et al. | |
| 2003/0217843 | A1 | 11/2003 | Mullins | |

FOREIGN PATENT DOCUMENTS

| | | |
|---|---|---|
| WO | WO 00/19058 | 4/2000 |

* cited by examiner

*Primary Examiner*—Shane Bomar
(74) *Attorney, Agent, or Firm*—Bracewell & Giuliani LLP

(57) ABSTRACT

A blow out preventer for operating between a spear of a tubular gripping tool and a tubular gripped by the tool includes: an expandable seal carried on the spear and expandable to seal between the spear and the tubular's inner wall, the expandable seal being operable as a back up to a primary seal operable between the spear and the tubular's inner wall. A tubular gripping tool and a method may include the blow out preventer.

12 Claims, 6 Drawing Sheets

SPEAR TYPE BLOW OUT PREVENTER

FIELD OF THE INVENTION

The present invention relates to an oilfield tool seal and, in particular, to a blow out preventer for use during tubular string handling.

BACKGROUND OF THE INVENTION

During oilfield drilling and borehole completion operations tubular strings may be handled in the form of the drill string, the casing or liner string for lining the borehole, etc. To grip the tubular and the tubular string, a tubular gripping clamp tool may be used. In some operations, such as casing drilling and/or casing running, a casing clamp may be used to grip the string at its upper end.

Sometimes an inside gripping clamp may be used. An example of such a gripping clamp is described in U.S. Pat. No. 6,742,584 of Appleton, and assigned to the present assignee TESCO Corporation. Alternately, an external gripping clamp may be used. As an example, such a gripping clamp is described in U.S. Pat. No. 6,311,792 of Scott, which is also assigned to the present assignee.

A tubular gripping clamp may be connected for manipulation by a top drive or other device, the entire assembly being suspended in a rig or derrick by a draw works, if desired.

Tubular gripping tools may include gripping means that engage the tubular being handled. Gripping means may include, for example, devices that mechanically or frictionally engage the tubular including, for example, slips, jaws, packers, expandable members, etc., catch devices that hook under a shoulder on the tubular being handled, such as elevators, etc. and/or other members that exert a mechanical or physical force or field on the tubular to engage it. Tubular gripping tools may also include spears, which are intended to extend into the bore of a tubular being handled. An external gripping tool may include a spear surrounded by gripping means that engage an outer surface of the tubular, while the spear is inserted into the inner diameter of the tubular. An inside gripping clamp may include a spear with gripping means thereon, such that when the spear extends into the bore of a tubular being handled the gripping means are positioned for engagement of the inner wall of the tubular.

A spear of a tubular gripping clamp may include a seal thereabout which is selected to engage and create a seal against the inner diameter of the tubular being handled. During operation, drilling fluid, commonly called mud and which can be liquid or gas-based, is pumped down through the spear and the seal creates a seal against the inner diameter to maintain fluid pressure in the tubular string. The seal generally is passive and operates against a pressure differential.

In a well control incident, it may be desirable to shut in the well, including sealing the upper end of the tubular string. If such an incident occurs during the use of a gripping clamp, well control may be achieved by reliance on the seal about the clamp's spear. As a next step, or where a failure of the passive seal is encountered, it may be desirable to support the tubular string in the floor of the derrick/rig and to remove the casing clamp from the tubular, such that the tubular string can be capped.

In the situation where both the draw works and the spear seal fail, the well may be very difficult to control.

SUMMARY OF THE INVENTION

In accordance with one aspect of the present invention, there is provided a blow out preventer for operating between a spear of a tubular gripping tool and a tubular gripped by the tool, the blow out preventer comprising: an expandable seal carried on the spear and expandable to seal between the spear and the tubular's inner wall, the expandable seal being operable as a back up to a primary seal operable between the spear and the tubular's inner wall.

In accordance with another broad aspect of the present invention, there is provided a tubular gripping clamp for gripping an oilfield tubular, the tubular gripping clamp comprising: a spear sized to extend into the bore of a tubular to be gripped, gripping means drivable to engage the tubular to be gripped and a primary seal about the spear to create a seal between the spear and the inner wall of the tubular, the primary seal being expandable in response to at least operationally generated fluid pressure differential in the tubular, and a secondary seal about the spear selectively operable to create a seal between the spear and the inner wall of the tubular.

In accordance with another aspect of the present invention, there is provided a blow out preventer assembly for operating between a tubular gripping tool and a tubular gripped by the tool, the blow out preventer assembly comprising: an expandable seal carried on the tubular gripping tool and expandable to seal between the tool and the tubular's inner wall and a drive system for selectively driving the expansion of the expandable seal.

In accordance with another broad aspect of the present invention, there is provided a method for shutting in a well while a tubular gripping tool remains positioned in the upper end of a tubular string extending into the well, the method comprising: providing an expandable seal about a spear of the tubular gripping tool that can be expanded selectively to seal between the spear and the inner diameter of a tubular and selectively expanding the seal to shut in the well.

DESCRIPTION OF VARIOUS EMBODIMENTS

Figure 1:
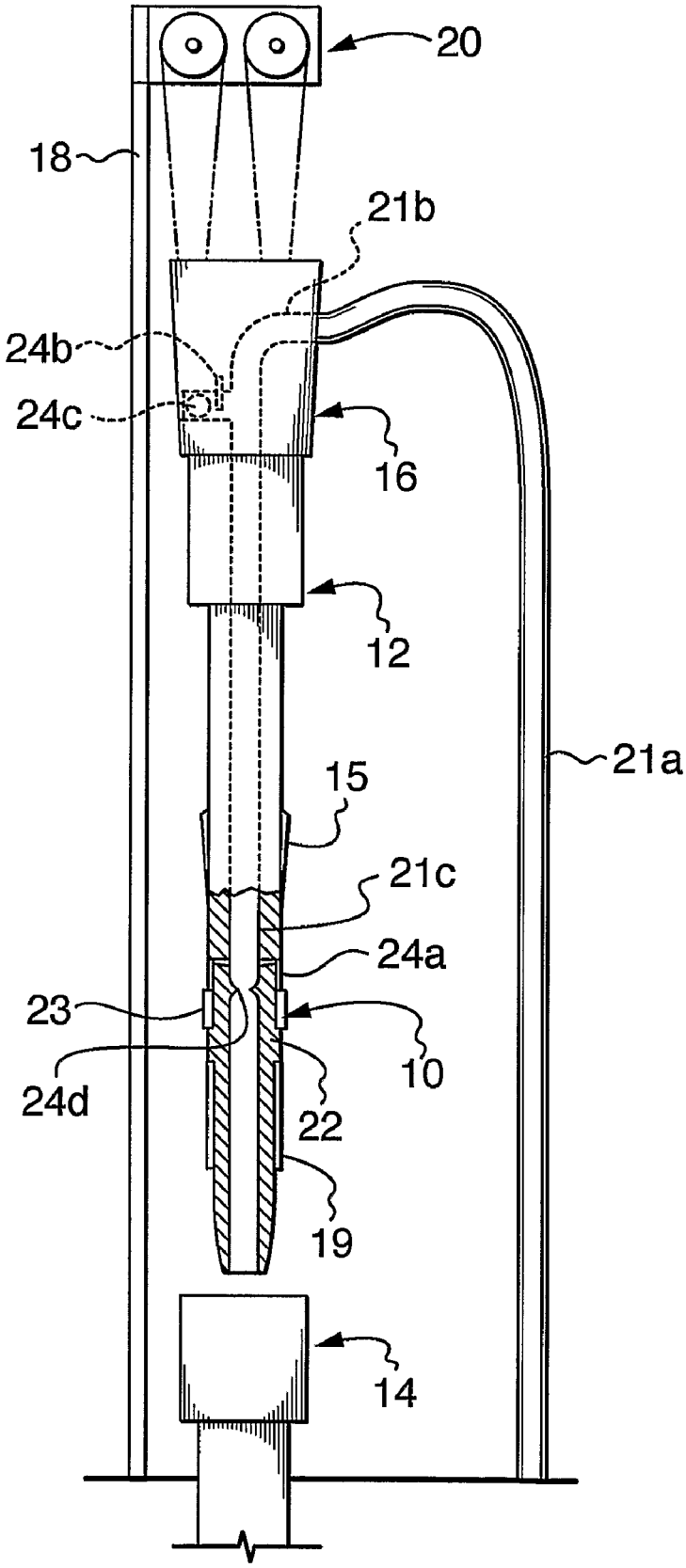
FIG. 1 is a schematic illustration of a blow out preventer assembly on an installed tubular gripping tool.

Referring to FIG. 1, a blow out preventer assembly 10 is provided for operating between a tubular gripping tool, such as a casing clamp 12 of the internal gripping type, as shown, or external gripping type (FIG. 2), and a tubular 14 gripped by a gripping means 15 on the tool 12. Inside gripping clamp 12 may be connected for manipulation by a top drive 16 or other device, the entire assembly of top drive 16 and clamp 12 may be suspended in a rig or derrick 18 by a draw works 20.

A mud flow path may be defined by lines and pipes 21*a* on the rig, a passage through the top drive 21*b* and an axial bore 21*c* through the clamp that opens at an end of a clamp spear 22 disposed in the tubular, when a tubular is gripped. The mud flow path provides that drilling fluid can be pumped from a mud supply to the tubular. A passive seal 19 may be mounted about the spear to act against fluids migrating up between the spear and the tubular during normal operations.

In a well control incident such as a well kick or other pressure surge from the formation, it may be desirable to shut in the well, including sealing the upper end of the tubular string. If such an incident occurs during the use of an inside gripping clamp and the passive seal about the clamp and the draw works fails, the blow out preventer assembly 10 can be operated to create a seal between the clamp and the tubular inner wall, to in effect seal the upper end of the tubular string.

Figure 6:
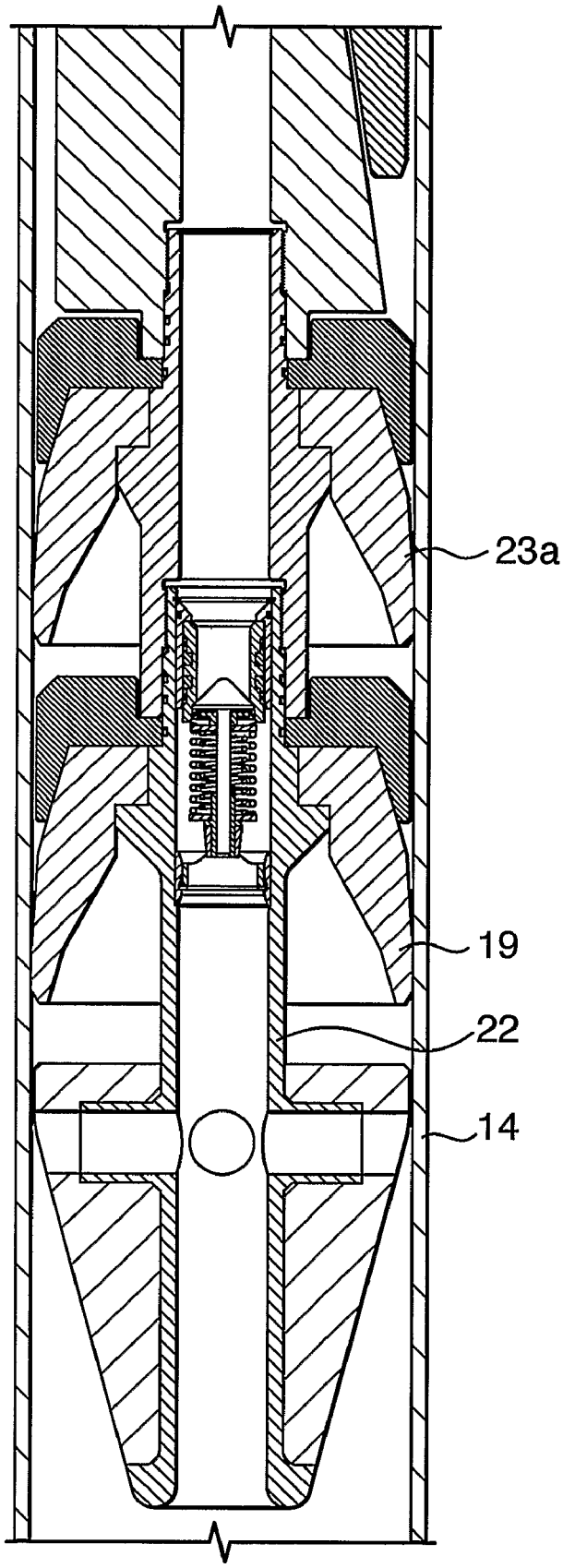
FIG. 6 is a schematic illustration of another blow out preventer assembly.

The blow out preventer assembly may, as shown in FIG. 6, include an expandable seal 23*a* operating in a passive manner, such as by use of a seal cup, positioned adjacent and upwardly of the primary passive seal 19, relative to the outboard end of spear 22. The secondary seal 23*a*, therefore, may act as a back up should the primary seal fail.

In another embodiment, as shown in FIG. 1, the blow out preventer assembly may include an expandable seal 23 carried on the tubular gripping tool and expandable to seal between the tool and the tubular's inner wall and a drive system 24*a*, 24*b*, 24*c*, 24*d* for the expandable seal. The drive system may be selected such that the seal is not normally driven out into engagement with the inner wall of the tubular, but only when it is necessary to contain a surge from the formation. In particular, it may be desirable that the drive means be selectively operable, for example, by other than a normal operational pressure differential such as by hydraulic or rotational drive. In a convenient embodiment for oilfield operations, the drive system may be hydraulically driven.

In the embodiment of FIG. 1, for example, expandable seal 23 may be mounted between a retainer and a piston 24*a* and can be driven by applying hydraulic pressure against piston 24*a* such that it is driven against the seal to cause it to extrude outwardly. The drive actuator may be a ball drop mechanism 24*b* including a ball 24*c* that is sized to pass from the mechanism to a seat 24*d* to cause a seal in bore 21*c* through the clamp. Ball drop mechanism 24*b* is positioned upstream of the seat, in this illustration adjacent the top drive. Seat 24*d* is positioned downstream of the piston 24*a* in bore 21*c* such that a ball sealed against the seat can be used to increase the fluid pressure against the piston to drive it against seal 23.

As will be appreciated, ball 24*c* may be a ball, a dart, a plug or other device that can pass through the mud flow path, but is sized to be stopped by and sealed against the seat. A ball drop mechanism can operate in many different ways, for example, by various mechanisms that may not be affected by normal drilling or tubular running operations, but may be actuated manually directly or remotely when a ball is to be released. Mechanisms may include, remotely or directly operated handles or valves, remotely or directly actuated solenoids, etc.

Figure 2:
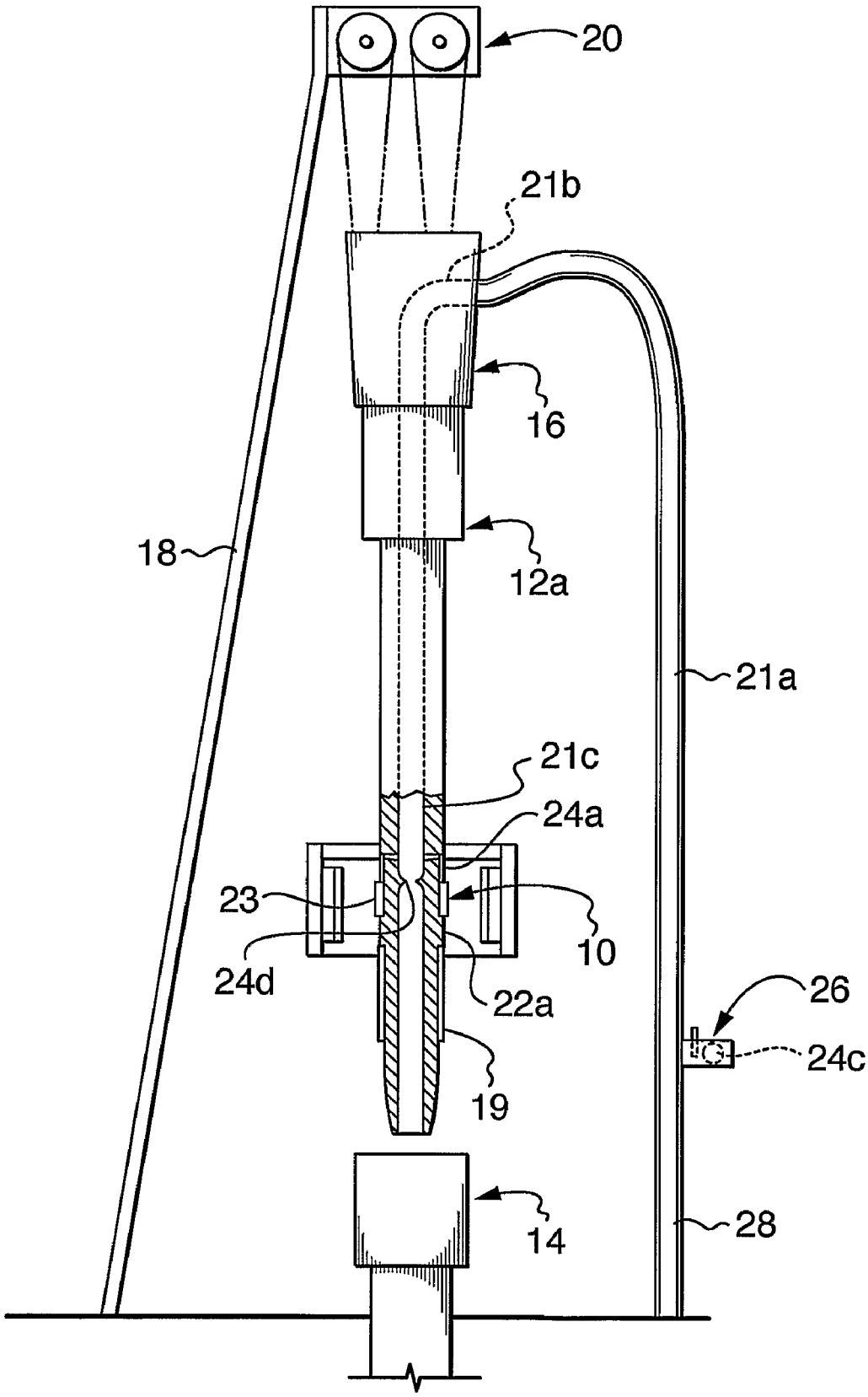
FIG. 2 is a schematic illustration of another blow out preventer assembly on an installed tubular gripping tool.

In another embodiment, such as that shown in FIG. 2, a clamp 12*a*, this time illustrated as an external-type clamp but may also be an internal-type clamp, may include a clamp spear 22*a* that carries an expandable seal 23, piston 24*a* and seat 24*d*. In this embodiment, ball drop mechanism 26 is located further away from the top drive/clamp than in the embodiment of FIG. 1. In this embodiment, the ball drop mechanism is positioned in a standpipe 28 adjacent the rig floor, which facilitates access thereto. The ball 24*c* is sized to pass through the ID of all of the mud flow lines 21*a*, through the top drive passage and through the axial bore of the clamp to reach seat 24*d*. It is to be understood that, in such arrangements, the ball drop mechanism can be installed anywhere upstream of the seat.

Figure 7:
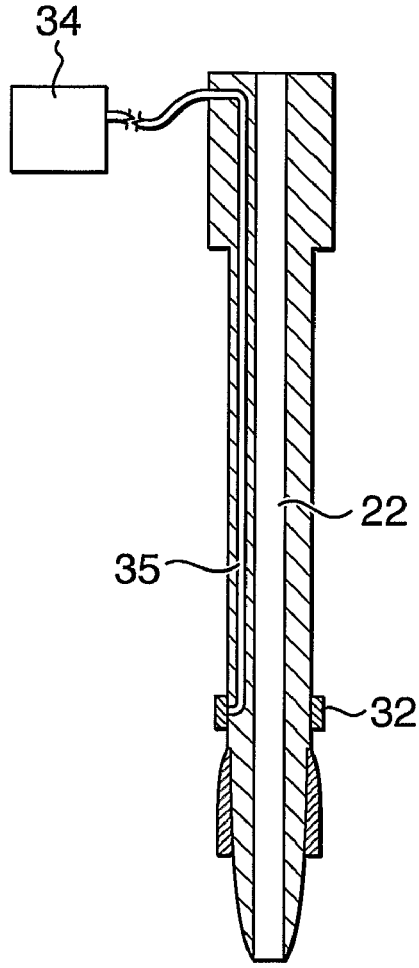
FIG. 7 is a schematic illustration of another blow out preventer assembly.

Another embodiment, as shown in FIG. 7, may use an expandable seal 32 on the spear of a clamp and a seal selectively drivable to expand out into a sealing condition about the spear by a drive system 34 including hydraulic pressure independent from the drilling fluid flow, as through a flow conduit 35 through lines or internal passages.

Thus, each of the embodiments of FIGS. 1, 2, 6 and 7 provide a method for shutting in a well during use of a tubular gripping tool and when it remains with its spear positioned in the upper end of a tubular string extending into the well, which may occur during a well incident and when the passive seal of the clamp fails and the draw works cannot be operated to remove the clamp from the end of the tubing string. The method can include expanding a clamp spear expandable seal, such as secondary passive seal 23*a*, seal 23 or seal 32, which is positioned about a spear for example 22 or 22*a* of the tubular gripping tool to create a seal between the spear and the inner diameter of the tubular string, thereby to seal the upper end of the tubular string.

The expandable seal may be expanded by a drive system that can be actuated selectively when it is desired to expand the seal. Various drive mechanisms may be useful, such as an arrangement that uses drilling mud to drive expansion, as in FIGS. 1 and 2, a system using another form of hydraulic pressure or another drive system.

It may be useful to test the operation of the seal, since it may only be used occasionally, but when used may be of great importance. In a test, for example, it may be useful to conduct a flow test wherein a ball 24*c* is pumped from its release point to ensure that it can pass to seat without being obstructed.

Figure 3:
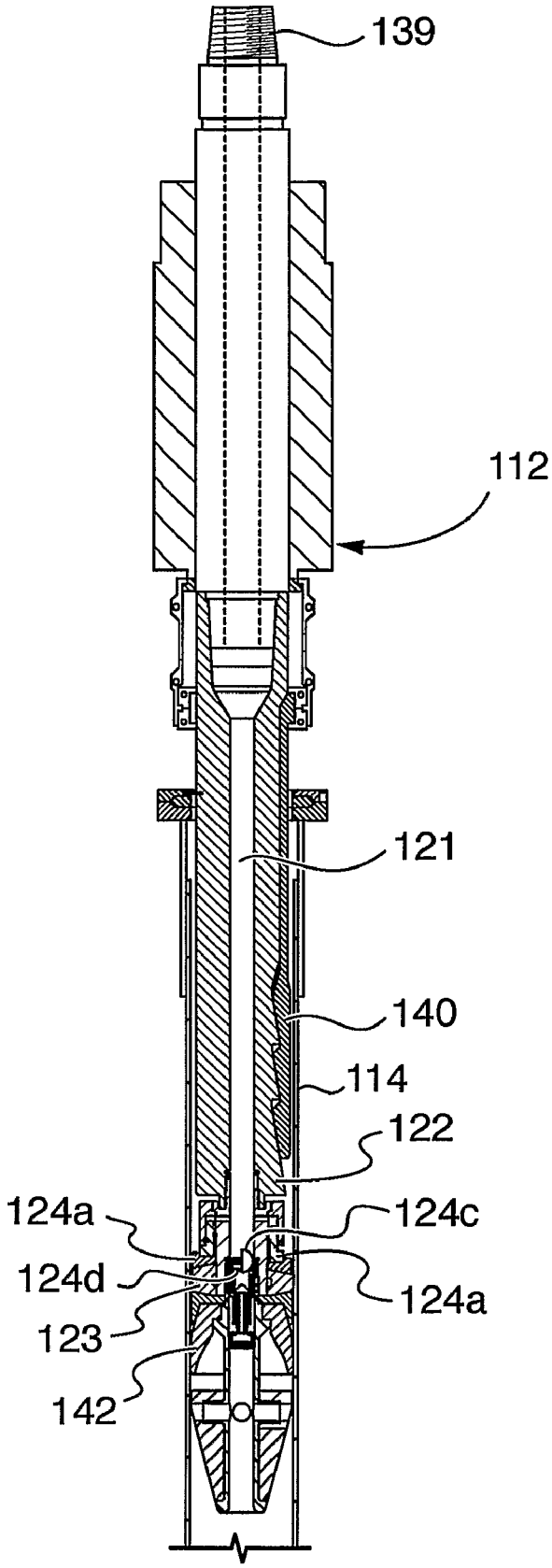
FIG. 3 is an axial section along a tubular gripping tool including a primary seal and a backup expandable seal, with the left hand side showing the backup seal in a non-expanded condition and the right hand side showing the backup seal in an expanded condition.
Figure 4:
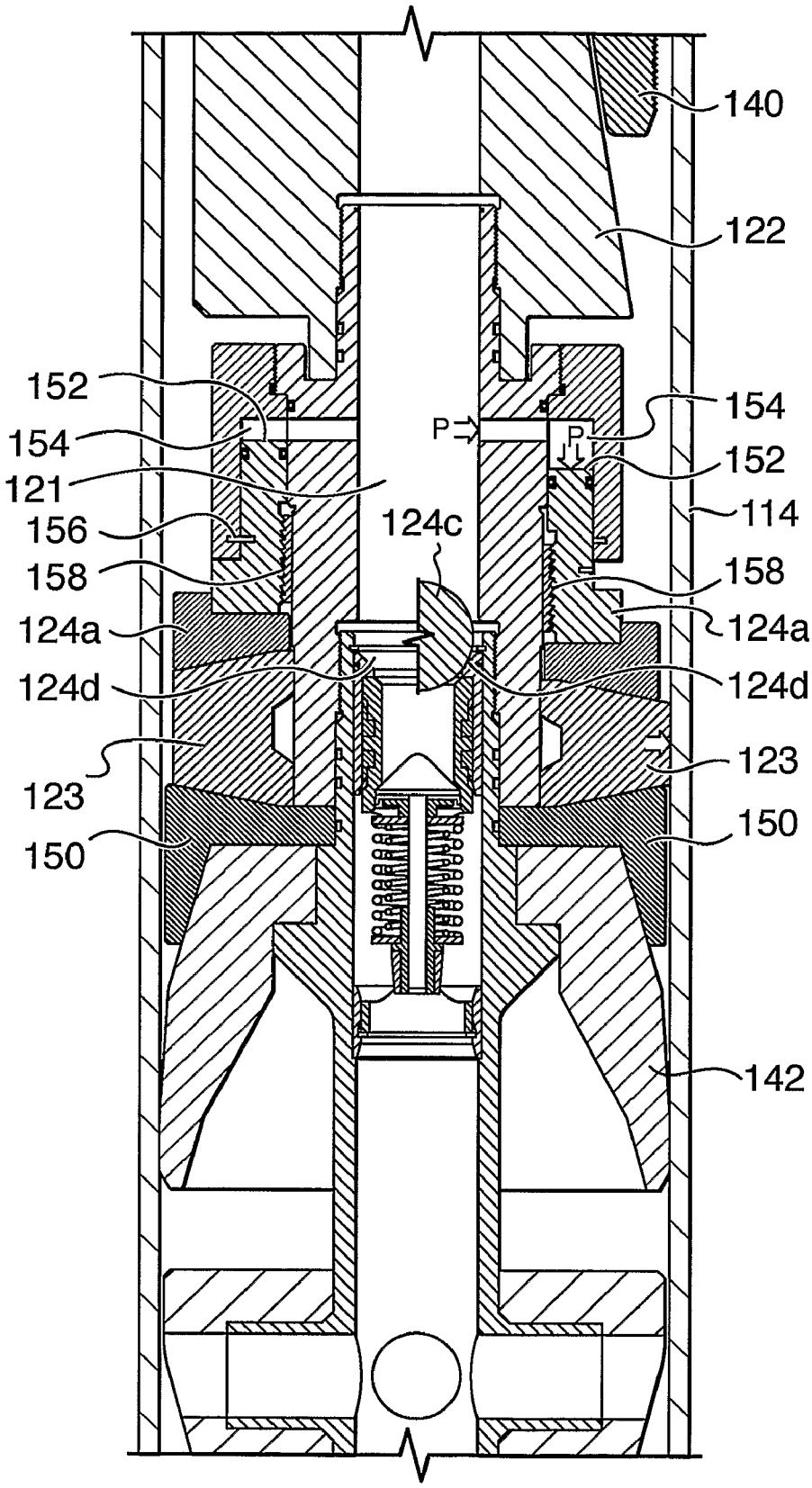
FIG. 4 is an axial section along a portion of a tubular gripping tool including a primary seal and a backup expandable seal, with the left hand side showing the backup seal in a non-expanded condition and the right hand side showing the backup seal in an expanded condition.

With reference to FIG. 3, an inside gripping clamp 112 is shown. Clamp 112 may be used for gripping an oilfield tubular 114 and may include an end 139 formed for connection to a top drive or other means for manipulating and/or suspending the clamp in a rig. Clamp 112 may include a spear 122 sized to extend into the bore of the tubular to be gripped, gripping slips 140, or other gripping means, positioned on the spear and drivable to engage the tubular to be gripped, a bore 121 through the clamp and its spear through which drilling fluid can pass into the tubular and a primary seal 142 about the spear to create a seal between the spear and the inner wall of the tubular. Primary seal 142 may be expandable in response to an at least operationally generated fluid pressure differential in the tubular. Clamp 112 may further include a secondary seal 123 about the spear which is selectively operable to create a seal between the spear and the inner wall of the tubular and, therefore, may be operated as a blow out preventer as a back up to primary seal 142. An enlarged view of the portion of the clamp about the primary and secondary seals is shown in FIG. 4.

As will be appreciated, clamp 112 may include any or all of the various additional parts shown in the illustrated embodiment such as a stabbing guide, a mud saver valve, a tubular stop flange, etc. Slips 140 and the drive system for the slips may take various forms, including those forms illustrated.

In normal operation of clamp 112, spear 122 is inserted into a tubular bore to grip the tubular during connection to or break out from a tubular string. When spear 122 is inserted into a tubular, primary seal 142 may seal against the inner wall of the tubular to contain drilling fluids in the tubular. In this normal operation, secondary seal 123 is maintained in a non-expanded condition such that it remains spaced from or not actively sealed against the tubular inner wall. This is shown in the left hand quarter sections of FIGS. 3 and 4.

Should a back up for primary seal 142 be necessary, seal 123 can be expanded to seal against the tubular inner wall.

Although many drive systems are possible, the drive system illustrated in FIGS. 3 and 4, acts by release of a ball 124*c* from a ball drop mechanism somewhere upstream of a seat 124*d* in bore 121. Ball 124*c* may be pumped with the drilling mud flow into the clamp to seal against seat 124*b* so that mud pressure can be used to inflate the seal.

Seal 123, as in the illustrated embodiment, may be an extrudable ring packer mounted between a fixed retainer ring 150 and a piston ring 124*a*, shown as a two-part arrangement including a piston face 152. Piston face 152 may be open in a hydraulic chamber 154 in fluid communication with bore 121. Piston ring 124*a* may be secured in position by one or more shear pins 156. Shear pins 156 may be selected to prevent movement of piston 124*a* under normal pressures but to permit movement when fluid pressures in excess of a selected rating are applied against face 152. An example of normal operational pressure where the packer would not be activated is 3,000 psi. In this case the shear pins may be set to actuate at 3,500 to 3,750 psi. A ratchet arrangement 158 may be disposed between spear 122 and piston ring 124*a* to lock the piston into its pressure driven, energized position.

As noted, pressures sufficient to shear pins 156 may be applied by landing a ball 124*c* against seat 124*d* such that pressure can be increased above the ball. This increased pressure may be communicated, arrows P, to chamber 154 and against face 152. Induced movement of piston 124*a* causes seal 123 to extrude out, arrow E, between the piston and retainer 150.

Figure 5:
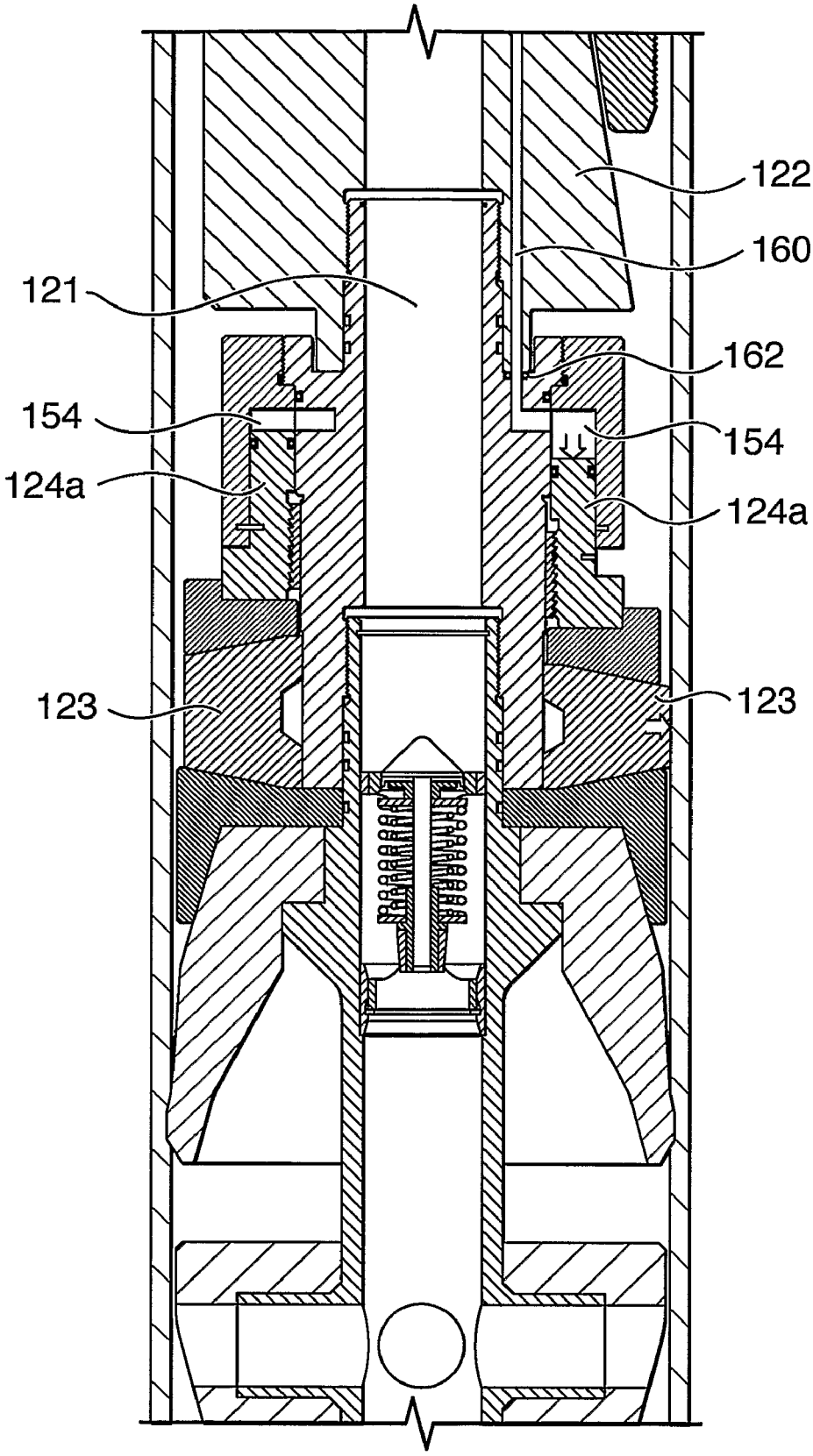
FIG. 5 is a quarter axial section along another tubular gripping tool with the left hand side showing the backup seal in a non-expanded condition and the right hand side showing the backup seal in an expanded condition.

In another embodiment, shown in FIG. 5, a hydraulic drive system that operates on a hydraulic source other than mud pressure in bore 121 can be used to drive expansion of the seal. In particular, piston 124*a* is operated by hydraulic fluid from a source pumped through passages 160 passing through the body of spear 122 into hydraulic chamber 154. Seals, such as o-rings 162 may be required at connections between the parts of the clamp.

The clamp and it various parts may be made of materials and with methods conducive to use in the oilfield industry, as will be appreciated.

While the foregoing description is illustrative of various embodiments of the present invention, it will be apparent to those of ordinary skill in the art that various modifications and changes may be made thereto without departing from the spirit and scope of the invention. Accordingly, it is not intended that the invention be limited, except by the appended claims.

I claim:

1. A casing gripping clamp for gripping a joint of casing of a casing string, comprising:

a spear having an axis and an axial passage for delivering drilling fluid into a casing string, the spear adapted to extend into the bore of a casing joint to be gripped;

grippers that are radially movable to engage and grip the casing joint to be gripped;

a primary seal element about the spear to create a seal between the spear and the inner wall of the casing joint, the primary seal element being urged radially outward relative to the axis of the spear into sealing engagement with the inner wall of the casing joint in response to drilling fluid pressure differential in the casing string; and a secondary seal element about the spear above and axially spaced out of contact with the primary seal element, the secondary seal element being selectively operable to create a seal between the spear and the inner wall of the easing joint in the event the primary seal element fails.

2. The casing gripping clamp of claim 1 wherein the clamp is an external-type clamp.

3. The casing gripping clamp of claim 1 wherein the clamp is an internal-type clamp, and wherein each of the primary and secondary seal elements has substantially the same dimensions and comprises a cup seal.

4. The casing gripping clamp of claim 1 wherein the secondary seal element is selectively operable by other than normal operational fluid pressure in the tubular to create a seal between the spear and the inner wall of the casing joint.

5. The casing gripping clamp of claim 4 further comprising a drive system to expand the secondary seal element.

6. The casing gripping clamp of claim 4 wherein the secondary seal element is extrudable by pressure applied by a drive system.

7. The casing gripping clamp of claim 4 wherein the drive system includes a feature operable based on hydraulics.

8. The casing gripping clamp of claim 7 further comprising a mud flow path through the spear and hydraulic pressure from the mud flow path acts on the drive system.

9. The casing gripping clamp of claim 7 further comprising:

a mud flow path through the spear;

a fluid communication conduit to communicate fluid pressure from the mud flow path and the drive system; and a control for creating a hydraulic pressure in the mud flow path capable of actuating the drive system to expand the secondary seal element.

10. The casing gripping clamp of claim 7 wherein hydraulic pressure independent from a mud flow path through the spear is used to operate the drive system.

11. The casing gripping clamp of claim 1 further comprising:

a mud flow path through the spear; and a hydraulically actuated drive system for causing expansion of the secondary seal element, the drive system including a valve in the mud flow path sealable to create fluid pressure in the mud flow path sufficient to actuate the drive system.

12. The casing gripping clamp of claim 11 wherein the valve includes a seat sealable by a launchable device sealable on the seat.

* * * * *